United States Patent [19]

Hauck

[11] 4,144,436

[45] Mar. 13, 1979

[54] MICROWAVE OVEN EXCITATION SYSTEM FOR PROMOTING UNIFORMITY OF ENERGY DISTRIBUTION

[75] Inventor: Harold S. Hauck, Louisville, Ky.

[73] Assignee: General Electric Company, Louisville, Ky.

[21] Appl. No.: 697,238

[22] Filed: Jun. 17, 1976

[51] Int. Cl.[2] ..... H05B 9/06

[52] U.S. Cl. ..... 219/10.55 F

[58] Field of Search ..... 219/10.55 F, 10.55 R; 333/10, 35

[56] References Cited

U.S. PATENT DOCUMENTS

| | | | |
|---|---|---|---|
| 2,473,274 | 6/1949 | Bradley | 333/10 |
| 2,627,573 | 2/1953 | Riblet | 333/10 |
| 2,923,895 | 2/1960 | Curtis et al. | 333/35 |
| 3,056,877 | 10/1962 | Schmidt et al. | 219/10.47 |
| 3,189,722 | 6/1965 | Fritz | 219/10.55 |
| 3,196,242 | 7/1965 | Vries et al. | 219/10.55 R |
| 3,210,511 | 10/1965 | Smith | 219/10.55 S |
| 3,221,132 | 11/1965 | Staats | 219/10.55 F |
| 3,263,052 | 7/1966 | Jeppson et al. | 219/10.55 R |
| 3,439,143 | 4/1969 | Cougoule | 219/10.55 F |
| 3,641,301 | 2/1972 | Ikeda | 219/10.55 F |
| 3,764,770 | 10/1973 | Saad et al. | 219/10.55 F |
| 3,993,886 | 11/1976 | Imberg et al. | 219/10.55 F |
| 4,019,009 | 4/1977 | Kusunoki et al. | 219/10.55 |

FOREIGN PATENT DOCUMENTS

| | | | |
|---|---|---|---|
| 1515070 | 7/1964 | Fed. Rep. of Germany | 219/10.55 F |
| 46-40979 | 5/1971 | Japan | 219/10.55 F |
| 47-38776 | 7/1972 | Japan | 219/10.55 F |
| 1407852 | 9/1975 | United Kingdom | 219/10.55 F |

OTHER PUBLICATIONS

Whiteley, Electronic Cooking Appliance, 3746823, 7/73.

Blass et al., Microwave ovens, 2704802, 3/55.

Gades et al., Composite Microwave Energy Perturbating Device, 3835280, 9/74.

Dygve et al., Microwave Oven with Antenna Chamber, Antenna and Rotation, 3851133, 11/74.

Staats, Electronic Dryer, 3854219, 12/74.

*Primary Examiner*—Arthur T. Grimley
*Assistant Examiner*—Bernard Roskoski
*Attorney, Agent, or Firm*—Radford M. Reams

[57] ABSTRACT

A microwave oven includes a relatively flat mode stirrer cavity mounted on the outside of one of the cooking cavity walls, sharing a common wall therewith. Disposed within the mode stirrer cavity is a rotating fan-like mode stirrer. A waveguide supplies 2450 MHz microwave energy to the mode stirrer cavity. Two aperture elements of generally slot configuration and oriented at right angles to each other in the common wall couple energy from the mode stirrer cavity into the cooking cavity. The configuration and relationship of the aperture elements promote uniformity of energy distribution and readily permit adjustment of the energy distribution by empirically adjusting the precise size and location of each aperture element. In one embodiment of the invention, two aperture elements overlap to form a single aperture of substantially cruciform configuration.

11 Claims, 7 Drawing Figures

MICROWAVE OVEN EXCITATION SYSTEM FOR PROMOTING UNIFORMITY OF ENERGY DISTRIBUTION

BACKGROUND OF THE INVENTION

1. Field of the Invention

The present invention relates to microwave ovens and more particularly to a microwave oven excitation system which produces improved uniformity of energy distribution within the cooking cavity.

2. Description of the Prior Art

In a microwave oven cooking cavity, the spatial distribution of the microwave energy tends to be non-uniform. As a result, "hot spots" and "cold spots" are produced at different locations. For many types of foods, cooking results are unsatisfactory under such conditions because some portions of the food may be completely cooked while others are barely warmed. The problem becomes more severe with foods of low thermal conductivity which do not readily conduct heat from the areas which are heated by the microwave energy to those areas which are not. An example of a food falling within this class is cake. However, other foods frequently cooked in microwave ovens, such as meat, also produce unsatisfactory cooking results if the distribution of microwave energy within the oven cavity is not uniform.

One explanation for the non-uniform cooking pattern is that electromagnetic standing wave patterns, known as "modes," are set up within the cooking cavity. When a standing wave pattern is set up, the intensities of the electric and magnetic fields vary greatly with position. The precise configuration of the standing wave or mode pattern is dependent at least upon the frequency of microwave energy used to excite the cavity and upon the dimensions of the cavity itself. It is possible to theoretically predict the particular mode patterns which may be present in the cavity, but actual experimental results are not always consistent with theory. This is particularly so in a countertop microwave oven operating at a frequency of 2450 MHz. Due to the relatively large number of theoretically possible modes, it is difficult to predict with certainty which of the modes will exist. The situation is further complicated by the differing loading effects of different types and quantities of food which may be placed in the cooking cavity.

In an effort to alleviate the problem of non-uniform energy distribution, a great many approaches have been tried. The most common approach is the use of a device known as a "mode stirrer," which typically resembles a fan having metal blades. The mode stirrer rotates and may be placed either within the cooking cavity itself (usually protected by a cover constructed of a material transparent to microwaves) or, to conserve space within the cooking cavity, may be mounted within a recess formed in one of the cooking cavity walls, normally the top.

The function of the mode stirrer is to continually alter the mode pattern within the cooking cavity. If a particular mode exists for only a moment, and then is immediately replaced by a mode having different hot and cold spots, then, averaged over a period of time, the energy distribution within the cavity is more uniform.

While many of the prior art approaches to achieving uniform energy distribution do work to some extent, few perform as well as is desired and many are unduly complicated.

By the present invention, there is provided an excitation system for a microwave oven which achieves an improved time-averaged energy distribution within the cooking cavity and which is extremely economical of manufacture.

SUMMARY OF THE INVENTION

Accordingly, it is an object of the invention to provide a microwave oven excitation system which promotes a uniform time-averaged distribution of microwave energy within the cooking cavity.

It is another object of the invention to provide such as excitation system which is economical of manufacture and which has a minimum of moving parts.

These and other objects are accomplished by the invention which is applied to a microwave oven of the type generally including a source of microwave energy such as a magnetron, a rectangular $TE_{10}$ mode waveguide having one end coupled to the source of microwave energy, and a box-like rectangular cooking cavity. The excitation system includes a relatively flat mode stirrer cavity mounted on the outside of one of the cooking cavity walls, preferrably the top wall, sharing a common wall therewith. The other end of the waveguide is connected to a rectangular opening in a side wall of the mode stirrer cavity. A rotating mode stirrer, such as a conventional fan-like mode stirrer, is disposed within the mode stirrer cavity. Within the wall common to the mode stirrer cavity and the cooking cavity, there are provided at least two aperture elements of generally slot configuration and oriented at right angles to each other for coupling energy from the mode stirrer cavity into the cooking cavity. This aperture element configuration and arrangement promotes the excitation of a large number of possible modes in the cooking cavity and makes it possible to conveniently adjust the excitation system to provide a desired energy distribution by experimentally adjusting the precise size and location of each aperture element.

The mode stirrer cavity is relatively flat, having a height of less than one-half wavelength and a horizontal extent of a plurality of half wavelengths. In a preferred embodiment, the mode stirrer cavity is of substantially square cross section and is so dimensioned that it can support a plurality of half waves in each of two orthogonal orientations at the operating frequency and wavelength. In other words, the mode stirrer cavity (including the mode stirrer) is a resonant cavity and as such is capable of storing microwave standing wave energy. Furthermore, the microwave standing wave energy has half wave variations in each of two orthogonal orientations, and this permits each of the aperture elements to be oriented in substantially parallel relationship to two opposed side walls of the cooking cavity, permitting favorable coupling to as many modes as possible in the rectangular cooking cavity. Another aspect of the resonant character of the mode stirrer cavity is that the "Q" of the excitation system is increased, for overall higher efficiency.

In one embodiment, two aperture elements overlap to form a single aperture of substantially cruciform configuration. In a particular configuration experimentally determined to be acceptable, the four arms of the cross were selected to have different lengths and widths. That is, the aperture was irregular. Once an acceptable aperture size and particular shape is determined for a particular oven model, additional production copies of identical configuration may be made and these copies may all be expected to perform similarly.

In an experimental procedure for adjusting the precise dimensions when a cruciform aperture is used, calibrated beakers of water are placed in a predetermined arrangement within the cooking cavity and the temperature rise of each in a given period of time measured. By trial and error, it is found that the energy in the rear part of the cooking cavity is generally a function of the width of the aperture element portion forming the rearwardly-extending arm of the cross. Similarly, adjustment of the width of the aperture element portions forming the other arms generally determines the amount of the energy available in the region of the cooking cavity below them. It should be noted that these relationships are approximate only, as the adjustments are interactive.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DESCRIPTION OF THE PREFERRED EMBODIMENTS

Figure 1:
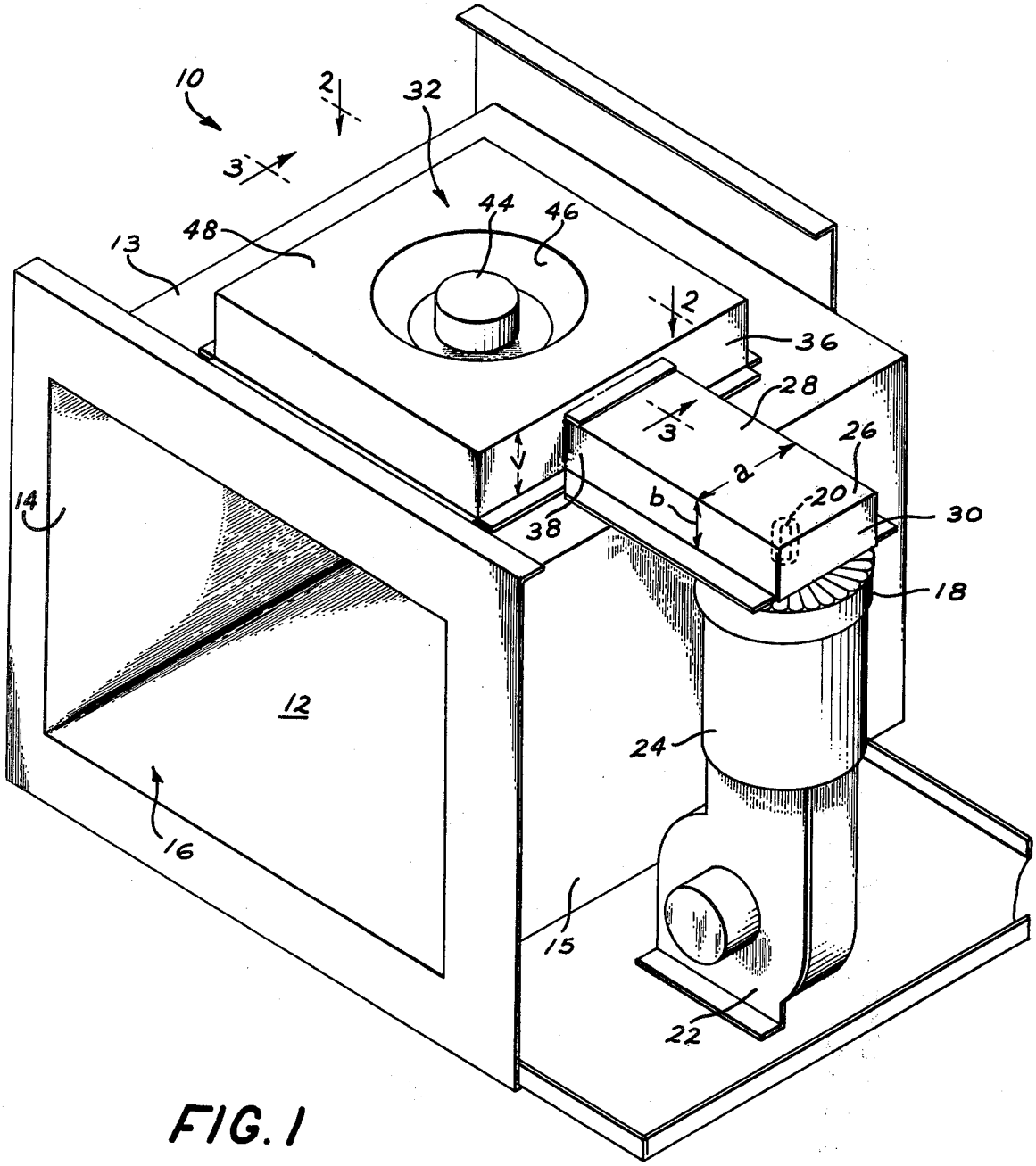
FIG. 1 is a front perspective view of a microwave oven with the outer cover removed and illustrating one arrangement according to the present invention.

Referring first to FIG. 1, there is shown a microwave oven generally designated at 10 and having the outer cover removed. It will be understood that numerous other components, not illustrated, are required in a complete microwave oven, but for clarity of illustration and description, only those elements believed essential for a proper understanding of the present invention are shown and described. The microwave oven 10 includes a cooking cavity 12 bounded by conductive walls, including a top wall 13 and left and right side walls 14 and 15. An access opening 16 is provided and, as will be understood, is covered by a conventional access door (not shown).

As is conventional, the source of microwave energy for the oven 10 is a magnetron 18 which produces 2450 MHz microwave energy output at the antenna or probe 20. In connection with the magnetron 18, a blower 22 to provide cooling airflow and a cylindrical rubber duct 24 for channeling the airflow over the magnetron cooling fins are included. It will be understood that numerous other components are required in a complete microwave oven, for example control and door interlock circuitry and a high voltage DC power supply for the magnetron 18. These elements may all be conventional, and as such are well known to those skilled in the art.

The output of the magnetron 18 is coupled by the probe 20 into one end 26 of a waveguide 28. A conductive, short-circuiting plate 30 closing off the one end 26 of the waveguide 28 is spaced approximately one-sixth wavelength from the probe 20. As is conventional, the waveguide 28 is so dimensioned to propagate 2450 MHz microwave energy in the $TE_{10}$ mode. The major dimension of the waveguide 28 is oriented in a horizontal plane, so the electric field pattern within the waveguide 28 extends vertically. To insure that substantially only $TE_{10}$ mode propagates in the waveguide 28, the width "a" along the major dimension is selected to be slightly more than one-half wavelength and the height "b" is selected to be less than one-half wavelength, preferably approximately 50 percent of the "a" dimension.

Figure 2:
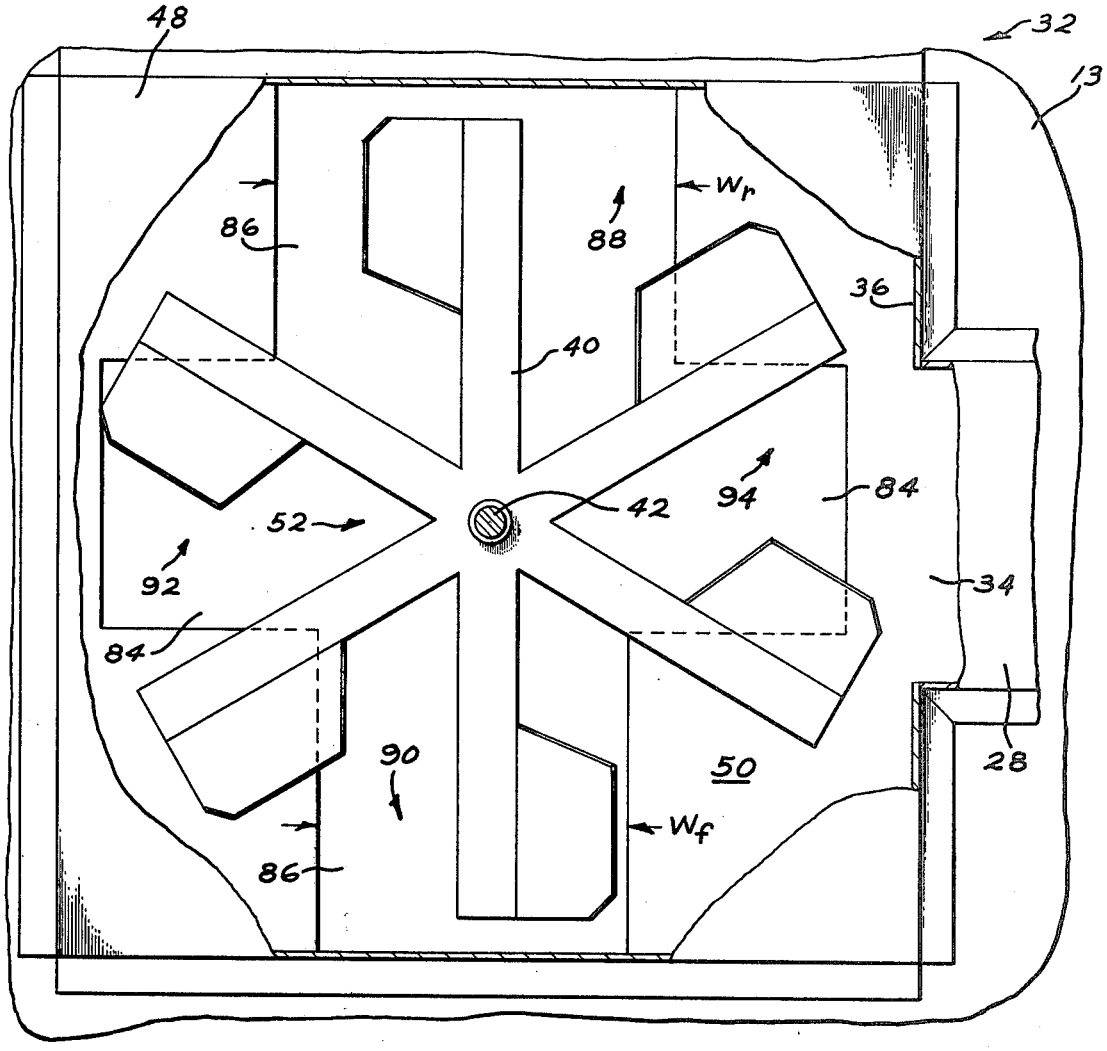
FIG. 2 is a view taken along line 2 — 2 of FIG. 1, with the mode stirrer driving motor removed and a portion of the upper wall of the mode stirrer cavity broken away to show the mode stirrer and the precise shape of a single cruciform coupling aperture formed by the overlapping aperture elements.
Figure 3:
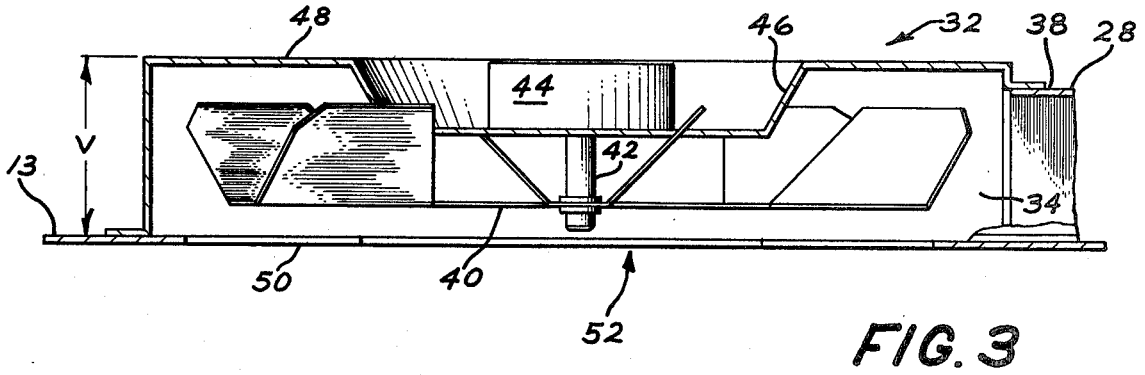
FIG. 3 is a side cross-sectional view of the mode stirrer cavity taken along line 3 — 3 of FIG. 1.

Referring now, in addition to FIG. 1, to FIGS. 2 and 3, the excitation system of the microwave oven 10 includes a mode stirrer cavity 32 including a rectangular opening 34 in the side wall 36 for connection to the other end 38 of the waveguide 28. The mode stirrer cavity 32 is relatively flat and has a vertical dimension "v" of less than one-half wavelength, and a horizontal extent of a plurality of half wavelengths. The illustrated mode stirrer cavity 32 has a substantially square cross section and extends horizontally sufficiently far to support a plurality of half-waves of standing wave energy in each of two orthogonal orientations. While the illustrated mode stirrer cavity 32 is substantially square in cross section, other shapes, for example circular, may be employed. A necessary characteristic, however, of the mode stirrer cavity 32 is that its horizontal extent be sufficient to support a plurality of half-wave variations in the electric field in each of two orthogonal orientations. The selection of a height "v" of less than one-half wavelength ensures that there are no full half-wave variations in the electric field in a vertical direction. As a result, there are vertical E fields in the mode stirrer cavity 32, as well as in the waveguide 28.

Positioned within the mode stirrer cavity 32 is a conventional fan-like rotatable mode stirrer 40 formed of conductive material. Means are provided for rotating the mode stirrer 40 about the vertical axis defined by the shaft 42. In the illustrated embodiment, a low-speed electric motor 44, turning at approximately 120 r.p.m., is employed for this purpose. It will be apparent that other rotating means may be employed, such as directing cooling air flow over the fan-like mode stirrer 40 to cause simple pinwheel rotation. In order to make the best use of available vertical space and thereby obtain the highest possible cooking cavity 12 within a given outer case height, the motor 44 is mounted within a downward recess 46 formed within the top wall 48 of the mode stirrer cavity 32.

A common wall 50 separates the mode stirrer cavity 32 and the cooking cavity 12. It is this common wall 50 which gives the mode stirrer cavity 32 its character as a separate cavity, rather than a mere recess in one of the cooking cavity walls. In the illustrated construction, the mode stirrer cavity 32 is fabricated without a bottom, but is mounted on the top wall 13 of the cooking cavity 12, so that the portion of the cooking cavity top wall 13 bounded by the side walls of the mode stirrer cavity 32 becomes the common wall 50.

While the mode stirrer cavity 32 is illustrated and described herein as being mounted on the top wall 13 of the cooking cavity 12, and further is illustrated and described as extending horizontally, it will be apparent that the mode stirrer cavity 32 could be mounted on any outside wall of the cooking cavity 12 without departing from the invention. For convenience in describing the illustrated embodiments, the term "horizontal extent" is used to describe the "width" of the mode stirrer cavity 32, and for such embodiments the two terms are intended to be synonymous. However, if the mode stirrer cavity 32 were mounted on a side wall of the cooking cavity 12 (embodiment not illustrated), then the "width" of the mode stirrer cavity 32 would actually be a vertical extent and the height of the mode stirrer cavity 32 would actually be measured along a horizontal line.

The improved excitation system contemplated by the present invention includes both the common wall 50 and at least two aperture elements of generally slot configuration and oriented at right angles to each other in the common wall 50. In the arrangement shown in FIG. 2, two aperture elements overlap to form a single aperture 52 of substantially cruciform configuration. However, as will now be shown, a number of other configurations are possible.

Figure 4:
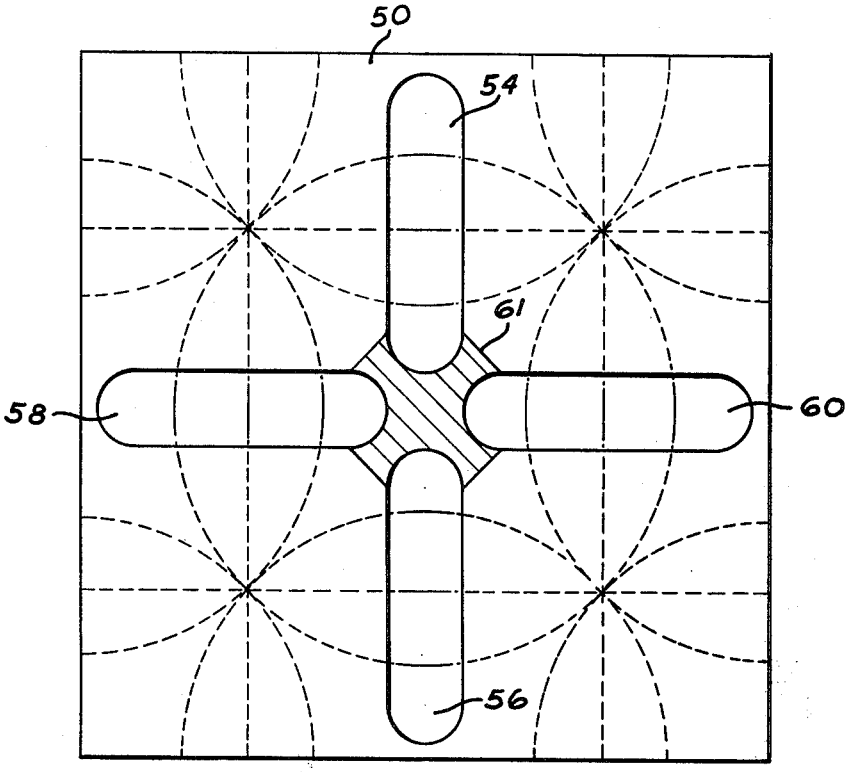
FIG. 4 illustrates the common wall with a configuration of unconnected aperture elements.

Referring now to FIG. 4, there is shown in the common wall 50, four unconnected aperture elements 54, 56, 58 and 60 of generally slot configuration. The aperture elements 54 and 56 are oriented at right angles to the aperture elements 58 and 60. Furthermore, the aperture elements are oriented in regular rectangular relationship with the side walls of the cooking cavity 12 (FIG. 1). That is, the aperture elements 54 and 56 are oriented in substantial parallel relationship to the opposed left and right side walls 14 and 15 of the cooking cavity 12, and the aperture elements 58 and 60 are oriented in substantial parallel relationship to the opposed rear wall (not shown) and front wall (formed by the access door, not shown) of the cooking cavity 12. Also shown in FIG. 4, in dash lines, is the configuration of conduction currents in the common wall 50, on the mode stirrer side thereof, for an exemplary standing wave pattern having two half-wave variations in each of two orthogonal orientations, along with the displacement current configuration across the aperture elements 54, 56, 58 and 60, shown in dot-dash lines, resulting from this standing wave pattern. The displacement currents produce E fields across the apertures, which E fields couple to modes having a similar spatial configuration of E fields within the cooking cavity 12.

It will be apparent that due to two sets of E fields being produced which are oriented at right angles to each other, and in various positions, coupling to a large number of possible modes in the cooking cavity 12 is promoted.

If the portion 61 of the common wall 50 (designated by shaded lines) is removed, a single aperture of cruciform configuration results. Since the current pattern may be expected to remain substantially unchanged, the energy distribution within the cooking cavity 12 may also be expected to be similar. One advantage to removal of the portion 61 is easier access to the mode stirrer shaft 42 (FIG. 3).

Figure 5:
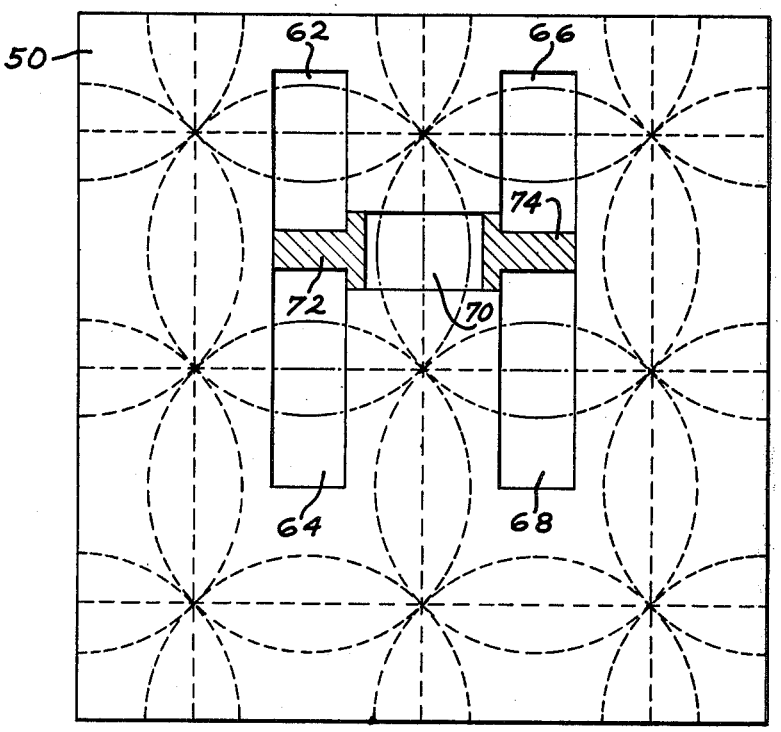
FIG. 5 illustrates the common wall with another configuration of aperture elements.

Referring next to FIG. 5, another configuration of aperture elements of generally slot configuration and oriented at right angles to each other is shown. Formed in the common wall 50 are unconnected aperture elements 62, 64, 66, 68 and 70 with the aperture element 70 being oriented at right angles to the other four aperture elements. In this case, a conduction current (dash lines) and displacement current (dot-dash lines) configuration resulting from an exemplary standing wave pattern having three half-wave variations in each of two orthogonal orientations is presented. Similarly, to the previously-described embodiment, if the shaded portions 72 and 74 are removed, a single aperture of "H" configuration results. In this case, an unsymmetrical arrangement for the aperture elements is selected, and the resulting "H" configured aperture is off-center. Again, in the FIG. 5 embodiment, E fields produced by displacement currents across the apertures couple to modes having a similar spatial configuration of E fields within the cooking cavity 12.

Figure 6:
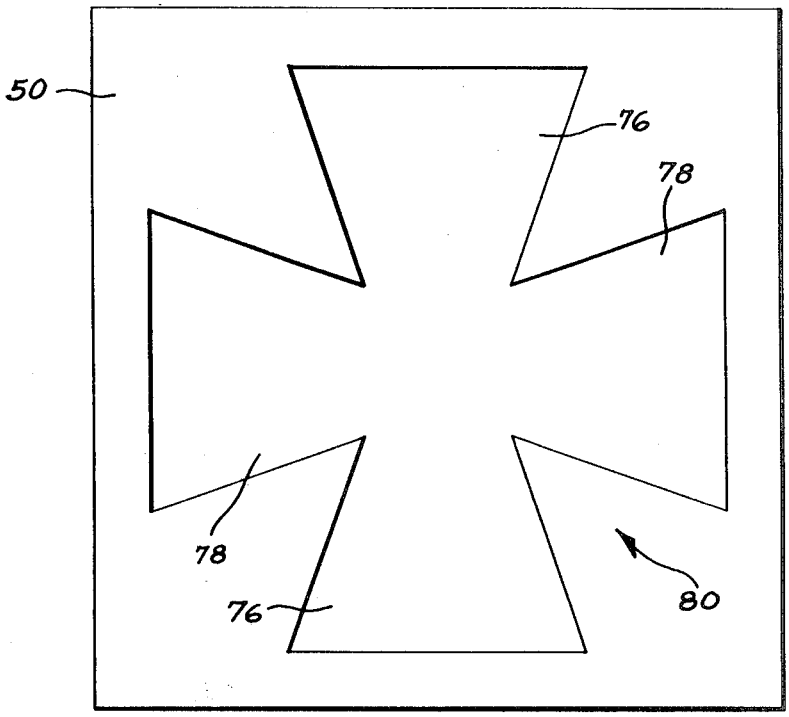
FIG. 6 illustrates the common wall with still another configuration of aperture elements.

FIG. 6 illustrates still another configuration of aperture elements in which aperture elements 76 and 78 overlap to form a single aperture 80 of generally cruciform configuration, but in which the end portions of the aperture elements 76 and 78 are distorted into trapezoidal configurations.

Figure 7:
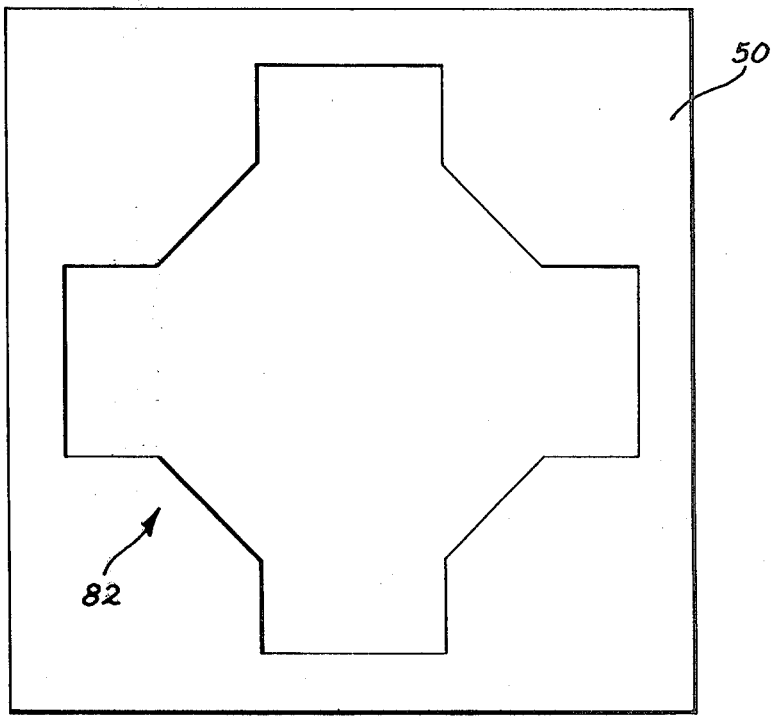
FIG. 7 is a view similar to FIG. 6 showing still another configuration.

Lastly, FIG. 7 illustrates another variation of aperture elements of generally slot configuration and oriented at right angles to each other. In this case, the aperture elements are connected and overlapping to form a single aperture 82 of generally cruciform configuration.

The various configurations illustrated are all variations of at least two aperture elements of generally slot configuration oriented at right angles to each other. Furthermore, each of the aperture elements is oriented in substantially parallel relationship to two opposed walls of the cooking cavity. When an excitation system having the general chracteristics described is constructed, it provides the means for adjustment and "fine tuning" to achieve a more uniform time-arranged energy distribution within the cooking cavity 12.

Going back now for a more detailed look at the configuration shown in FIG. 2, the single aperture 52 is formed of two overlapping aperture elements 84 and 86. One portion of the aperture element 86 forms the rear arm 88 of the cruciform aperture 52, with the other portion of the aperture element 86 forming the front arm 90. Similarly, portions of the aperture element 84 form left and right side arms 92 and 94. It will be apparent that the aperture elements 84 and 86 forming the cruciform aperture 52 are somewhat irregular. That is, the width $W_r$ of the rear arm 88 is somewhat greater than the width $W_f$ of the front arm 90, and the left and right side arms 92 and 94 are somewhat shorter in length than the front and rear arms 90 and 88.

The width of each of the arms 88, 90, 92 and 94 is experimentally adjusted, using trial and error methods, to achieve a desirable energy distribution. While any width and length for the arms which provides acceptable operation may be used, it is believed that widths within the range of from approximately one-fourth wavelength to one wavelength are to be preferred. It is believed that an arm width of a full wavelength or greater reduces the amount of horizontal E field coupling into the cooking cavity 12 and results in a decrease in a number of different modes which are excited. When the width of the arms is made excessively narrow, the impedance looking through the aperture 52 becomes higher, with the result that energy transfer therethrough is impaired, decreasing overall cooking efficiency. If the arms of the aperture 52 are at least a half wavelength, the oven 10 is easier of assembly because the mode stirrer 40 may be inserted from below from within the cooking cavity 12 through the aperture 50. The illustrated mode stirrer 40 may be manually manipulated to fit through the aperture 52.

In the method of empirically adjusting the excitation system to achieve a desirable energy distribution within the oven, any acceptable technique for experimentally measuring the energy distribution produced by a given configuration may be employed. For example, a plurality of beakers each having a predetermined quantity of water may be placed at various positions within the cavity 12. The magnetron 18 is then operated for a standardized period of time, and the temperature rise in each of the beakers is measured to determine the different rates of heating of the water in the various beakers. By adjusting the size, width, and position of the aperture elements, the energy distribution within the cavity 12 may be adjusted. It has been found, for example, when the aperture 52 (FIG. 2) is employed, for a beaker placed near the rear of the cooking cavity 12, the heating rate of water in that beaker is a function of the width of the rear arm 88. Similarly, the heating rates of beakers placed on the left and right sides and the front of the cooking cavity 12 are functions of the widths of the left side arm 92, the right side arm 94, and the front arm 90 respectively. The relationships are approximate only, as the adjustments are interactive. Since the precise mode pattern and the precise manner of coupling thereto are not known, experimentation such as described in required. Nonetheless, the provision of the common wall 50 having aperture elements, as described, permits such experimentation leading to desirable results to be accomplished.

In one particular embodiment of the invention, employing a single cruciform aperture as in FIG. 2, dimensions were as follows:

| | |
|---|---|
| **Cooking Cavity 12** | |
| Width | 13.75 inches |
| Depth | 15.75 inches |
| Height | 11.62 inches |
| **Mode Stirrer Cavity 32** | |
| Width | 9.2 inches |
| Depth | 9.4 inches |
| Height | 2.0 inches |
| **Cruciform Aperture 52** | |
| Overall, front to rear | 9.34 inches |
| Overall, left to right | 8.12 inches |
| Width of rear arm 88 (Wr) | 4.4 inches |
| Width of front arm 90 (Wf) | 3.4 inches |
| Width of left and right side arms 92 and 94 | 2.9 inches |

In the operation of the excitation system of the present invention, microwave energy produced by the magnetron 18 is coupled into and propagates through the waveguide 28 to enter the mode stirrer cavity 32. The energy is generally coupled from the mode stirrer cavity 32 through the aperture elements into the cooking cavity 12. It is believed that the orientation of the aperture elements permits various types of coupling to the various modes which may exist in the cooking cavity 12 at various times. As is known to those skilled in the art, the precise electromagnetic mode pattern present within the cooking cavity 12 depends both upon the dimensions of the cavity 12 and upon the precise frequency of the microwave energy produced by the magnetron 18. The precise operating frequency of the magnetron is not fixed, but rather is dependent upon the impedance of the load which is presented at the one end 26 of the waveguide 28 and "seen" by the magnetron. As the conductive mode stirrer 40 rotates, it causes the load impedance presented to the magnetron 18, and thus the output frequency, to cyclically vary. As a result, the frequency of the energy supplied to the cavity 12 varies within a band of frequencies centered on approximately 2450 MHz.

It will be apparent that, since the modes theoretically possible in the cavity depend in part upon the precise excitation frequency, as the frequency is varied, a number of different modes are theoretically possible at different times. Whether a particular mode in fact occurs, also depends upon whether that particular mode is sufficiently excited. For a particular mode to be excited requires that energy be coupled to it in the proper relationship with the standing wave pattern. Thus the relationship of the aperture elements to the top wall 14 of the cooking cavity influences to which of the possible modes coupling actually occurs. Furthermore, it is believed that irregular shapes for the aperture elements, as experimentally selected, cause various degrees of coupling to the several modes. By balancing the intensities the various modes which occur at various times, the overall relationship between hot and cold spots within the oven may be controlled.

As a more concrete example, for one particular cooking cavity, it is calculated that during the period of one mode stirrer rotation, the magnetron 18, at various moments, produces output on frequencies at which 530, 314, 153, 261, 062, 531, and 234 modes could exist within the cooking cavity 12. In other words, each of these modes could occur within the cooking cavity 12 during one stirrer rotation. Whether a mode actually exists and, if so, the intensity thereof, depends upon the degree of coupling to the mode. The degree of coupling to the various modes is dependent upon the precise configuration of the cruciform aperture 52. The ultimate time-averaged energy distribution within the cooking cavity 12, and thus the cooking performance, depends upon how the standing wave patterns for these six modes average over the period of one mode stirrer rotation, taking into account the intensity and duration of each mode.

Additionally, interaction between the rotating mode stirrer 40 and the slots, results in coupling variations and further variations in mode excitation.

The end result of all of this is believed to be the promotion of the actual existence of a relatively large number of modes in the cooking cavity 12. When many different modes are excited, each with different patterns and appropriate intensities, the resultant overall time-averaged energy distribution tends to be more uniform that if fewer modes are excited. Furthermore, the invention permits ready empirical determination of the precise dimensions and locations of the aperture elements for a desirable energy distribution.

A further benefit of the invention, in addition to improved uniformity of energy distribution, is that energy storage in the mode stirrer cavity 32 coupled to the cooking cavity 12 improves the overall efficiency of the oven 10.

Although the theory of operation of the invention is at the present uncertain and usually complex, the foregoing explanation of the operation is offered as the best available based upon known phenomena in order to offer some understanding. In any event, regardless of the exact manner of operation, when an excitation system is constructed in accordance with the invention as described hereinabove, improved uniformity of cooking results.

It will be apparent therefore, that the present invention provides an excitation system for a microwave oven which produces improved time-averaged uniformity of microwave energy distribution within the cavity, as evidenced by improved cooking performance, and which furthermore is economical of construction.

While a specific embodiment of the invention has been illustrated and described therein, it is realized that numerous modifications and changes will occur to those skilled in the art. It is therefore to be understood that the appended claims are intended to cover all such modifications and changes as fall within the true spirit and scope of the invention.

What is claimed is:

1. In a microwave oven of the type including a source of microwave energy of a predetermined center frequency and wavelength, a rectangular waveguide having an end coupled to the source of microwave energy, and a box-like rectangular cooking cavity capable of supporting a plurality of electromagnetic standing wave modes, an excitation system comprising:

a relatively flat mode stirrer cavity including a mode stirrer, said mode stirrer cavity having a horizontal extent sufficient to support a plurality of half-waves of standing wave energy in each of two orthogonal orientations, said mode stirrer cavity thus being a resonant cavity capable of storing microwave standing wave energy, and said mode stirrer cavity having an opening in one side wall connected to receive microwave energy from the other end of the waveguide;

a fixed common wall separating said mode stirrer cavity and the cooking cavity; and at least two aperture elements of generally slot configuration in said common wall for coupling microwave energy from said mode stirrer cavity into the cooking cavity, said aperture elements being oriented at right angles to each other.

2. The microwave oven of claim 1, wherein said mode stirrer cavity has a height of less than one-half wavelength.

3. The microwave oven of claim 1, wherein each of said aperture elements is oriented in substantially parallel relationship to two opposed side walls of the cooking cavity.

4. The microwave oven of claim 1, wherein said aperture elements are adjusted to achieve a substantially uniform time-averaged distribution of microwave energy within the cooking cavity.

5. The microwave oven of claim 1, wherein two of said aperture elements overlap to form a single aperture of substantially cruciform configuration, said cruciform aperture having four arms.

6. The microwave oven of claim 5, wherein said cruciform aperture is adjusted to achieve a substantially uniform time-averaged distribution of microwave enegy in the cooking cavity.

7. The microwave oven of claim 5, wherein the arms of said cruciform aperture are irregular in size and shape with respect to each other.

8. The microwave oven of claim 5, wherein the width of each of the arms of said cruciform aperture is less than one wavelength.

9. The microwave oven of claim 6, wherein the width of each of the arms of said cruciform aperture is within the range of from approximately one-half wavelength to a full wavelength.

10. The microwave oven of claim 1, wherein said aperture elements are irregular in size and shape with respect to each other.

11. The microwave oven of claim 1, wherein said aperture elements are unsymmetrically located with respect to the center of said mode stirrer cavity.

* * * * *